US007287691B2

(12) United States Patent
Montanari

(10) Patent No.: US 7,287,691 B2
(45) Date of Patent: Oct. 30, 2007

(54) METHOD AND MACHINE FOR MAKING AN ARTICLE PRESENTING A SECRET CODE HIDDEN BY A LAYER OF OPAQUE REMOVABLE MATERIAL

(75) Inventor: Nicola Montanari, Bologna (IT)

(73) Assignee: Nimax S.R.L., Bologna (IT)

( * ) Notice: Subject to any disclaimer, the term of this patent is extended or adjusted under 35 U.S.C. 154(b) by 475 days.

(21) Appl. No.: 10/859,549

(22) Filed: Jun. 3, 2004

(65) Prior Publication Data

US 2005/0121525 A1 Jun. 9, 2005

(30) Foreign Application Priority Data

Jun. 10, 2003 (EP) ..... 03425362

(51) Int. Cl.
*G06K 5/00* (2006.01)

(52) U.S. Cl. ..... 235/380; 235/488; 235/494

(58) Field of Classification Search ..... 235/375, 235/486–488, 494, 380; 283/94, 100, 111, 283/74; 40/201–203, 124.05, 124.191, 630; 428/38, 40.1, 41.7, 41.8, 42.2, 64.6, 204
See application file for complete search history.

(56) References Cited

U.S. PATENT DOCUMENTS 4,191,376 A * 3/1980 Goldman et al. ..... 273/139
5,714,743 A * 2/1998 Chiba et al. ..... 235/449
6,030,691 A * 2/2000 Burchard et al. ..... 428/195.1
6,655,719 B1 * 12/2003 Curiel ..... 283/86
6,752,319 B2 * 6/2004 Ehrhart et al. ..... 235/486
2004/0124243 A1 * 7/2004 Gatto et al. ..... 235/487

FOREIGN PATENT DOCUMENTS

| | | | |
|---|---|---|---|
| FR | 2660599 | A | 10/1991 |
| FR | 2679830 | A | 2/1993 |
| FR | 2739322 | A | 4/1997 |
| GB | 2252270 | A | 8/1992 |
| GB | 2352422 | A | 1/2001 |
| WO | 02070280 | A | 9/2002 |

* cited by examiner

*Primary Examiner*—Michael G. Lee
*Assistant Examiner*—Kumiko C. Koyama
(74) *Attorney, Agent, or Firm*—The Nath Law Group; Jerald L. Meyer; Matthew J. Moffa

(57) ABSTRACT

In a method for making an article, in particular a card of plastic or paper, presenting a secret code hidden by a layer of opaque, removable material, a first application device applies the secret code on the article, a second application device places the layer of opaque removable material over the secret code and a marking device impresses on the article an anti-counterfeit mark; the latter is made by at least one laser beam and at least partly on the layer of opaque removable material in such a way as to selectively remove a part of the opaque removable material to produce a defined anti-counterfeit code.

20 Claims, 2 Drawing Sheets

METHOD AND MACHINE FOR MAKING AN ARTICLE PRESENTING A SECRET CODE HIDDEN BY A LAYER OF OPAQUE REMOVABLE MATERIAL

BACKGROUND OF THE INVENTION

The present invention relates to a method and a machine for making an article presenting a secret code hidden by a layer of opaque removable material.

The present specification refers, but without thereby adhere restricting the scope of the invention, to articles made of paper or plastic, such as cards, coupons, tickets or tokens having a certain monetary value and distributed by private or public service organizations. More specifically, this specification refers, purely by way of example, to phone recharge cards which, as is known, have on them a secret numeric code hidden by a layer of opaque, removable material. The latter usually consists of a film of scratch-off ink, which disintegrates into minute particles when scratched and which can be scraped off the paper using a blade, coin or similar item.

The ink film may be applied directly to the paper or to one side of transparent plastic label whose other side has a permanent adhesive on it, by which it sticks to the card in such a way as to cover the code. In both cases, the only way of exposing the code to view is by scraping off at least part of the ink film, which means that it is easy for anyone looking at the card to see whether someone else has already gained access to the code.

Although both methods of hiding the code have been widely adopted because of their simplicity, relatively inexpensive machines are now readily available which can be used to restore the layer of ink for fraudulent purposes.

SUMMARY OF THE INVENTION

The present invention has for an aim to provide a method which can be used to make an article presenting a secret code hidden by a layer of opaque removable material and which is free of the above mentioned disadvantage.

The technical characteristics of the invention, with reference to the above aim, can be easily inferred from the appended claims, in particular claim 1, and preferably any of the claims that depend, whether directly or indirectly, on claim 1.

Another aim of the invention is to provide a machine which can be used to make, in a simple and economical manner, an article presenting a secret code hidden by a layer of opaque removable material and which overcomes the above mentioned disadvantage.

Accordingly, the invention provides a machine as defined in claim 11 and, preferably, in any of the claims that depend, whether directly or indirectly, on claim 11.

BRIEF DESCRIPTION OF THE DRAWINGS

The advantages of the invention are apparent from the detailed description which follows, with reference to the accompanying drawings which illustrate a preferred embodiment of the invention provided merely by way of example and without restricting the scope of the inventive concept. In the accompanying drawings.

DESCRIPTION OF THE PREFERRED EMBODIMENTS

With reference to the accompanying drawings, the numeral 1 denotes in its entirety a machine for making articles 2, each presenting a secret code 3 hidden by a layer 4 or film of opaque, removable material. More specifically, the layer 4 consists of a film of scratch-off ink that can be removed by scraping. Alternatively, the layer 4 may consist of an opaque material that can be removed with a solvent.

Figure 1:
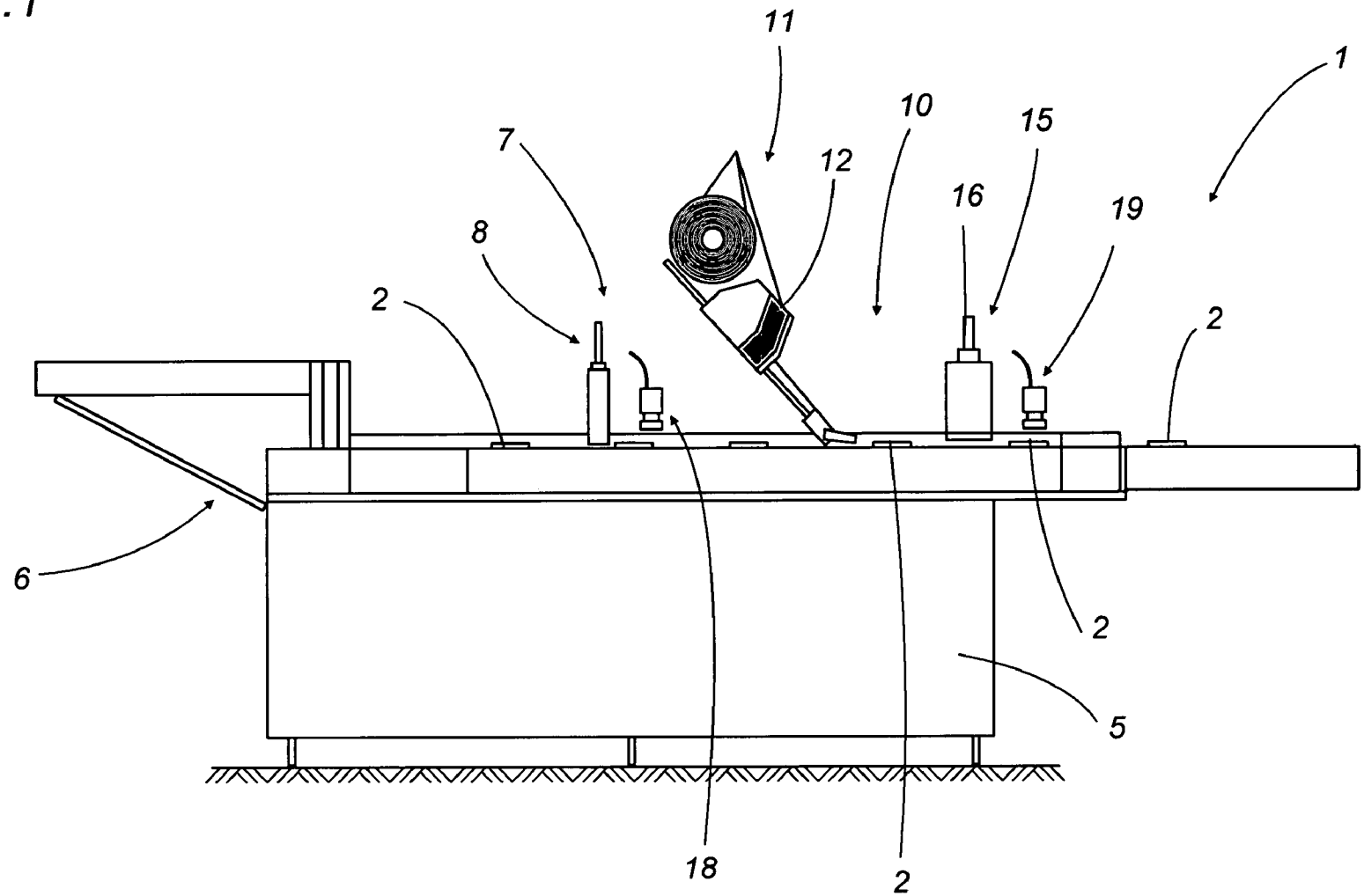
FIG. 1 is a schematic front view of an embodiment of the machine according to the present invention.
Figure 2:
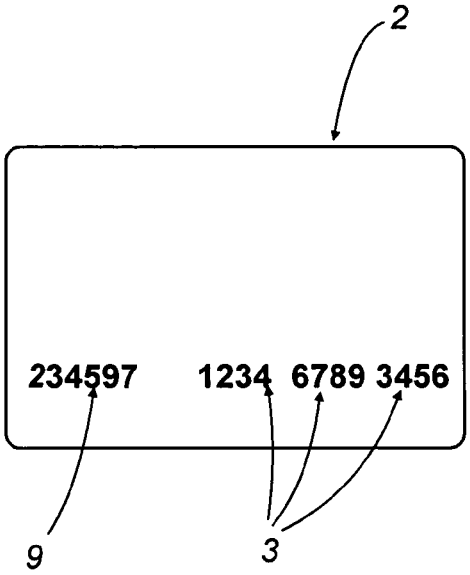
FIGS. 2 and 3 illustrate two intermediate, successive stages in the production of the article according to the present invention.
Figure 3:
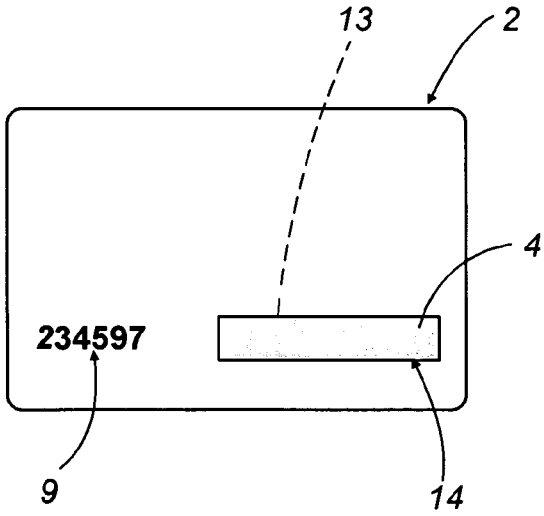

In the exemplary embodiment described, illustrated in FIGS. 2 to 4, each article 2 made by the machine 1 is a plastic or paper card, such as, for example, a phone recharge card or a card for a scratch and win contest.

The machine 1 comprises a base 5 along which there extends a conveying and processing line 6 for the articles 2.

At a first processing station 7 on the line 6, the machine 1 is equipped with a first application device 8 comprising a printing device of known type designed to print on each article 2 a code 3 and another code 9, for example, a serial code. Unlike the code 3, the code 9 is designed to remain visible and not to be hidden by the layer 4. The code 9 may be positioned alongside and in line with the code 3, as shown in FIG. 2.

Downstream of the station 7, along the line 6, the machine 1 presents a second station 10, equipped with a second application device 11 designed to apply the layer 4 to completely cover the code 3. The device 11 comprises a labeling unit 12 for permanently fixing a transparent label 13 on each article 2. The layer 4 is applied, or more precisely, printed, so that it totally covers one side of the label 13, whose other side is permanently fixed by means of a transparent adhesive to the article 2 in such a way as to cover the code 3.

According to another embodiment which is not illustrated, the labeling unit 12 is substituted by a printing device that applies the layer 4 directly on each article 2 over the code 3.

In both cases, the layer 4 completely hides the code 3 and is delimited by an edge 14, in this instance rectangular, along which it adheres directly to the article 2.

Downstream of the station 7, along the line 6, the machine 1 presents a third station 15, equipped with at least one marking device 16 designed to apply on each article 2 at least one anti-counterfeit marking 17 made at least partly on the layer 4. The device 16, of known type, comprises at least one unit for emitting at least one marking laser beam.

Downstream of the stations 7 and 15 there are two cameras 18 and 19 controlled by an apparatus (not illustrated) designed to check that the stations 7 and 15, respectively, are working correctly.

More specifically, the camera 18 checks the quality and position of the printing of the codes 3 and 9, whilst the camera 19 checks both the position of the label 12, or the position and print quality of the layer 4, and the position and quality of the marking 17.

The invention will now be described with reference to the operation of the machine 1 from the moment an article 2 is fed through the station 7.

At the station 7, the device 8 prints on the article 2 the codes 3 and 9, whose printing quality and position are checked by the camera 18 located downstream of the station 7. The article 2 passes through the inspection field of the camera 18, as shown in FIG. 2.

Next, at the station 10, the label 13, already covered completely by the layer 4, is applied to the article 2. The label 13 is glued over the code 3 in such a way as to hide it, as shown in FIG. 3.

At this point, the article 2 reaches the station 15, where it is marked by the laser marking device 16. Depending on how it is positioned relative to the feed line of the layer 4, the device 16 may apply on the article 2 a marking 17 of the type shown in FIG. 4*a* or a marking 17 of the type shown in FIG. 4*b*.

Figure 4A:
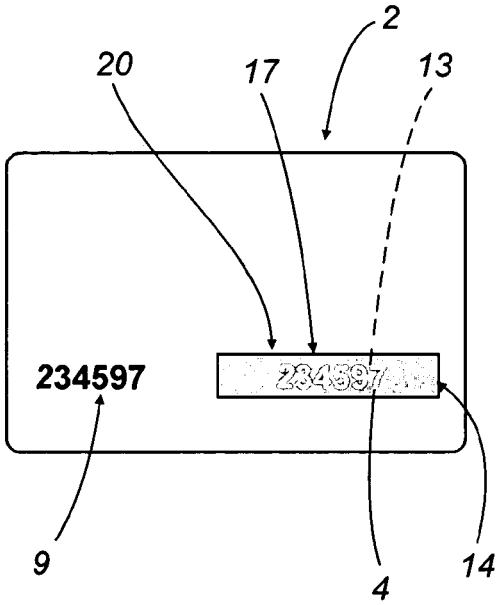
FIGS. 4*a* and 4*b* illustrate two alternative final stages in the production of the article according to the present invention.

In the case shown in FIG. 4*a*, the marking 17 is substantially centered on the layer 4 and is made by selectively removing part of the layer 4 itself. The marking 17 reproduces the image of an anti-counterfeit code 20 on the layer 4.

Figure 4B:
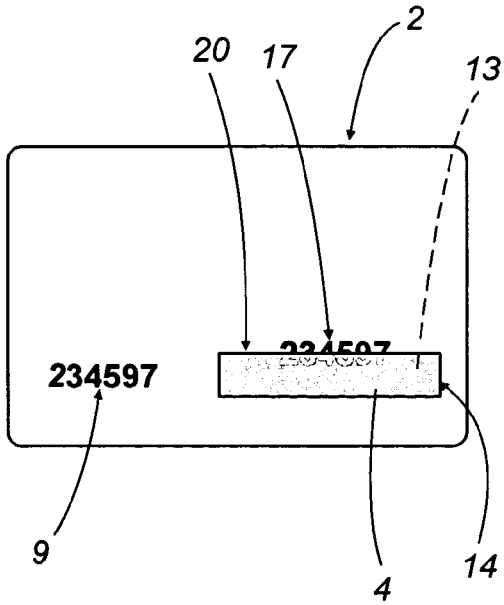

In the case shown in FIG. 4*b*, the marking 17 again reproduces the image of an anti-counterfeit code 20 but is not centered relative to the layer 4. In this case, the image overlaps the edge 14 of the layer 4, the first part of it being made directly on the article 2 by burning or engraving the latter, while the remaining, second part is made by selectively removing part of the layer 4 itself.

In both cases, selective removal of the layer 4 does not affect the latter's function, which is that of hiding the code 3 from view until the layer 4 is scratched off. Further, the code 20 in both cases may be a numeric or alphanumeric code. Preferably, as shown in FIGS. 4*a* and 4*b*, the code 20 is an exact copy of the code 9.

After passing the station 15, the article 2 is checked by the camera 19 before being fed out of the conveying and processing line 6.

It will be understood that the invention described, useful in many industrial applications, may be modified and adapted in several ways without thereby departing from the scope of the inventive concept and that all the details of the invention may be substituted by technically equivalent elements.

What is claimed is:

1. A method for making an article presenting a secret code hidden by a layer of opaque, removable material; the method comprising the steps of applying the code on the article and hiding the secret code under the layer of opaque, removable material; the method further comprising a step of applying on the article at least one anti-counterfeit marking made at least partly on the layer of opaque, removable material; the marking producing on the article an image of an anti-counterfeit code; said image being reproduced in such a way that the image overlaps at least one edge of the layer, a first part of the image being applied directly on the article and the remaining, second part of the image being made on the layer by selective removal of the opaque, removable material.

2. The method according to claim 1, wherein the marking is made by at least one laser beam.

3. The method according to claim 1, wherein the marking is made by selectively removing the opaque, removable material.

4. The method according to claim 3, wherein the selective removal of the opaque, removable material produces on the layer the image of an anti-counterfeit code.

5. The method according to claim 4, wherein the anti-counterfeit code is a numeric code.

6. The method according to claim 4, wherein the anti-counterfeit code is an alphanumeric code.

7. The method according to claim 4, further comprising a step of applying an additional code, exposed to view, on the article; the anti-counterfeit code being an exact copy of the additional code.

8. The method according to claim 1, wherein the layer of opaque, removable material is applied directly on the article to cover the secret code.

9. The method according to claim 1, wherein the layer of opaque, removable material is applied on one side of a transparent label, whose other side is fixed permanently to the article in such a way as to cover the secret code.

10. An article presenting a secret code hidden by a layer of opaque, removable material; the article comprising at least one anti-counterfeit marking made at least partly on the layer of opaque, removable material; the marking producing on the article an image of an anti-counterfeit code; said image being reproduced in such a way that the image overlaps at least one edge of the layer, a first part of the image being applied directly on the article and the remaining, second part of the image being made on the layer by selective removal of the opaque, removable material.

11. The article according to claim 10, wherein the marking is made by at least one laser beam.

12. The article according to claim 10, wherein the marking is made by selectively removing the opaque, removable material.

13. The article according to claim 12, wherein the selective removal of the opaque, removable material produces on the layer the image of an anti-counterfeit code.

14. The article according to claim 13, wherein the anti-counterfeit code is a numeric code.

15. The article according to claim 13, wherein the anti-counterfeit code is an alphanumeric code.

16. The article according to claim 13, comprising an additional code that is exposed to view; the anti-counterfeit code being an exact copy of this additional code.

17. The article according to claim 10, wherein the layer of opaque, removable material is applied directly on the article to cover the secret code.

18. The article according to claim 10, wherein the layer of opaque, removable material is applied on one side of a transparent label, whose other side is fixed permanently to the article in such a way as to cover the secret code.

19. The article according to claim 10, comprising a card or ticket made of plastic or paper.

20. The article according to claim 10, wherein the layer of opaque, removable material can be removed by scraping or by the use of a solvent.

* * * * *